US012339101B2

(12) United States Patent
Portoghese et al.

(10) Patent No.: US 12,339,101 B2
(45) Date of Patent: Jun. 24, 2025

(54) DEVICE TO CAPTURE PRESSURE DATA FROM A WEAPON'S FOREGRIP DURING LIVE FIRE

(71) Applicant: United States of America as represented by the Secretary of the Navy, Patuxent River, MD (US)

(72) Inventors: Rocco Portoghese, Winter Park, FL (US); Matthew Lankford, Merritt Island, FL (US)

( * ) Notice: Subject to any disclaimer, the term of this patent is extended or adjusted under 35 U.S.C. 154(b) by 766 days.

(21) Appl. No.: 17/699,258

(22) Filed: Mar. 21, 2022

(65) Prior Publication Data

US 2023/0296353 A1 Sep. 21, 2023

(51) Int. Cl.

| | |
|---|---|
| ***F41G 3/26*** | (2006.01) |
| ***F41C 23/16*** | (2006.01) |
| ***F41G 11/00*** | (2006.01) |

(52) U.S. Cl.

CPC ..... *F41G 3/26* (2013.01); *F41C 23/16* (2013.01); *F41G 11/003* (2013.01)

(58) Field of Classification Search

USPC ..... 42/1.01

See application file for complete search history.

(56) References Cited

U.S. PATENT DOCUMENTS 4,457,715 A * 7/1984 Knight ..... A63B 69/04 434/22

* cited by examiner

*Primary Examiner* — Reginald S Tillman, Jr.

(57) ABSTRACT

A device to capture pressure data from a weapon's foregrip during live fire, the weapon having a Picatinny accessory rail, the device comprising a plurality of sensor bodies that are mountable to the Picatinny accessory rail, each sensor body having a pressure sensitive region that can capture pressure data placed on the pressure sensitive region, each sensor body having channels that correspond to the Picatinny accessory rail, retention latch system that attaches the sensor body to the weapon; and, a communication assembly that allows data communication between the plurality of sensor bodies and a computer.

1 Claim, 8 Drawing Sheets

DEVICE TO CAPTURE PRESSURE DATA FROM A WEAPON'S FOREGRIP DURING LIVE FIRE

STATEMENT OF GOVERNMENT INTEREST

The invention described herein may be manufactured and used by or for the Government of the United States of America for governmental purposes without payment of any royalties thereon or therefor.

BACKGROUND

Marksmanship is a foundational skill required of military personnel, law enforcement personnel, and any civil servant entrusted with a firearm. Great emphasis is placed upon the acquisition and maintenance of marksmanship, especially for military and law enforcement personnel. A marksmanship instructor is a shooter's first and best resource for the acquisition and maintenance of this vital skill. The marksmanship instructor faces many demands upon his/her time and abilities. In modern military and law enforcement firing ranges, each instructor typically oversees multiple students. Time on the firing range and ammunition for training is limited and expensive. Any deficiencies in a particular shooter's performance that require a disproportionate amount of an instructor's time to diagnose and remediate performance issues takes instruction away from other trainees. Reshoots and retries consume both valuable time and ammunition. Furthermore, a shooter that cannot demonstrate proper marksmanship at the range quickly enough is in danger of being removed from the firing line and forced to repeat more basic training, incurring yet more expense.

The marksmanship instructor is tasked with teaching his/her students the fundamentals of marksmanship in the safest, quickest, and most effective way possible. The Armed Services have identified several marksmanship fundamentals including aiming, breath control, trigger squeeze, and steady position. If a shooter is not accurate, he/she is usually deficient in one or more of these fundamentals. However, the root cause of a shooter's poor marksmanship is not always readily apparent even to an experienced instructor. The difficulty and danger of close observation of the shooter at a live fire range, the small physical differences between acceptable and poor weapon handling, and the extremely transient nature of firing events force instructors to very often rely solely on the most heuristic measure of performance available to them—the fall of shot. A poor fall of shot, however, is only the symptom of poor marksmanship. The marksmanship instructor often cannot determine in which fundamental the shooter is lacking solely from their fall of shot. Therefore, marksmanship instructors need something to aid them in monitoring marksmanship fundamentals. Technology that can mitigate these inherent difficulties and expose the root causes of poor marksmanship will increase the marksmanship instructor's efficiency, effectiveness, and analytic capability and is consequently of great value to both the instructor and the student.

The Naval Warfare Center Training Systems Division (NAWCTSD) recently invented a system to provide a marksmanship instructor with a set of technological tools to allow him/her to more effectively and quickly diagnose and remediate poor shooting at the live fire range. This invention was granted U.S. Pat. No. 10,024,631 on Jul. 17, 2018 (this patent is herein incorporated by reference and is not admitted to be prior art). The invention, among other things, determines pressure that a shooter places on a trigger.

However, it does not collect or determine pressure placed by a shooter on the foregrip of the weapon. Marksmanship instructors indicated that it would be useful to be able to observe the pressure applied to not only the weapon's trigger but the weapon's foregrip. Tendencies that lead to poor marksmanship, such as squeezing, twisting, or applying lateral pressure to the foregrip when aiming or jerking on the foregrip during trigger pull, could be detected if grip pressure were measured. Thus, there was identified a need for a device that measures and records grip pressure of a shooter on a foregrip.

SUMMARY

The present invention is directed to a device to capture pressure data from a weapon's foregrip, that meets the needs enumerated above and below.

The present invention is directed to a device to capture pressure data from a weapon's foregrip during live fire, wherein the weapon has a Picatinny accessory rail, and the device includes a plurality of sensor bodies and a communications assembly. The plurality of sensor bodies are mountable to the Picatinny accessory rail, and each sensor body has a pressure sensitive region that can capture pressure data placed on the pressure sensitive region. Each sensor body also has channels that correspond to the Picatinny accessory rail, a retention latch system that attaches the sensor body to the weapon, and a communication assembly that allows data communication between the plurality of sensor bodies and a computer.

It is a feature of the invention to provide a device to capture pressure data from a weapon's foregrip during live fire wherein the device can be used to help with a shooter's performance issues, particularly incorrect trigger squeeze pressure by the shooter.

It is a feature of the invention to provide a device to capture pressure data from a weapon's foregrip during live fire that captures the pressure applied to the foregrip without affecting the handling of the weapon.

It is a feature of the present invention to provide a device to capture pressure data from a weapon's foregrip during live fire that is installed on a shooter's own weapon within seconds and is easy to use.

It is a feature of the present invention to provide a device to capture pressure data from a weapon's foregrip during live fire that does not greatly increase the size of the handgrip and does not add enough bulk to adversely or noticeably affect weapon handling.

DRAWINGS

These and other features, aspects and advantages of the present invention will become better understood with reference to the following description and appended claims, and accompanying drawings wherein:

DESCRIPTION

Figure 1:
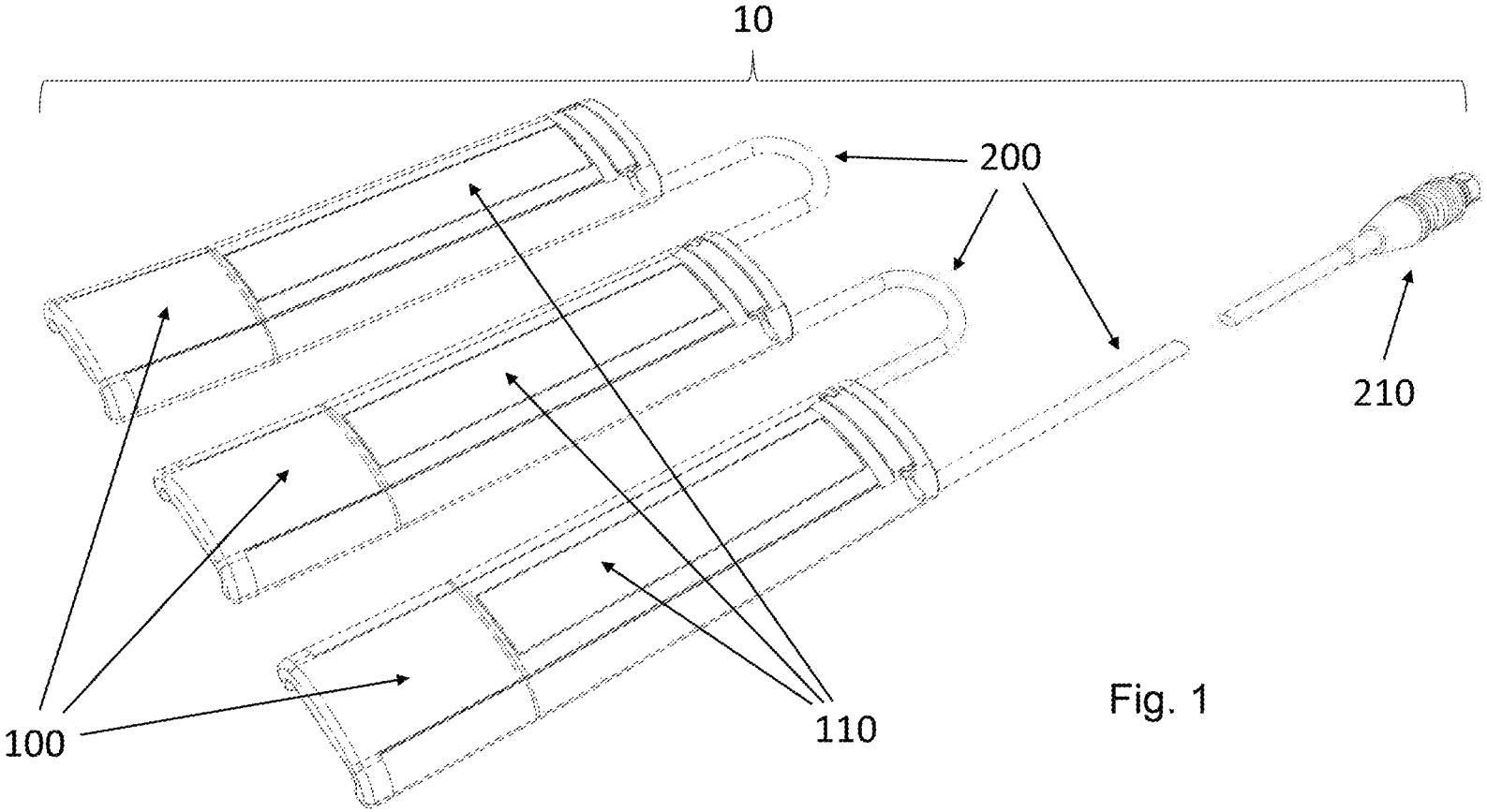
FIG. 1 is a perspective view of the foregrip pressure sensor device.

The preferred embodiments of the present invention are illustrated by way of example below and in FIGS. 1-8. As shown in FIG. 1, the device 10 to capture pressure data from a weapon's foregrip during live fire includes a plurality of sensor bodies 100, each with a pressure sensitive region 110, a plurality of integral interconnecting cables 200 to enable data transfer between sensor bodies 100, and an electrical connector 210 that allows transmission of pressure sensor data to a data collection device (not shown) or computer (not shown). In the preferred embodiment of the invention, the device 10 consists of three sensor bodies 100 that are manufactured from plastic. However, the sensor bodies 100 may be manufactured from any material practicable. Each sensor body 100 pressure sensitive region 110 sums the pressure applied to the region 110 by the shooter. In operation, sensor data is sent to a data collector integrated with the system or a computer. The data may be sent via integral interconnecting cable 200 and electrical connector 210 or any communication means practicable.

In the description of the present invention, the invention will be discussed in a military environment; however, this invention can be utilized for any type of application related to weapons training.

Figure 2:
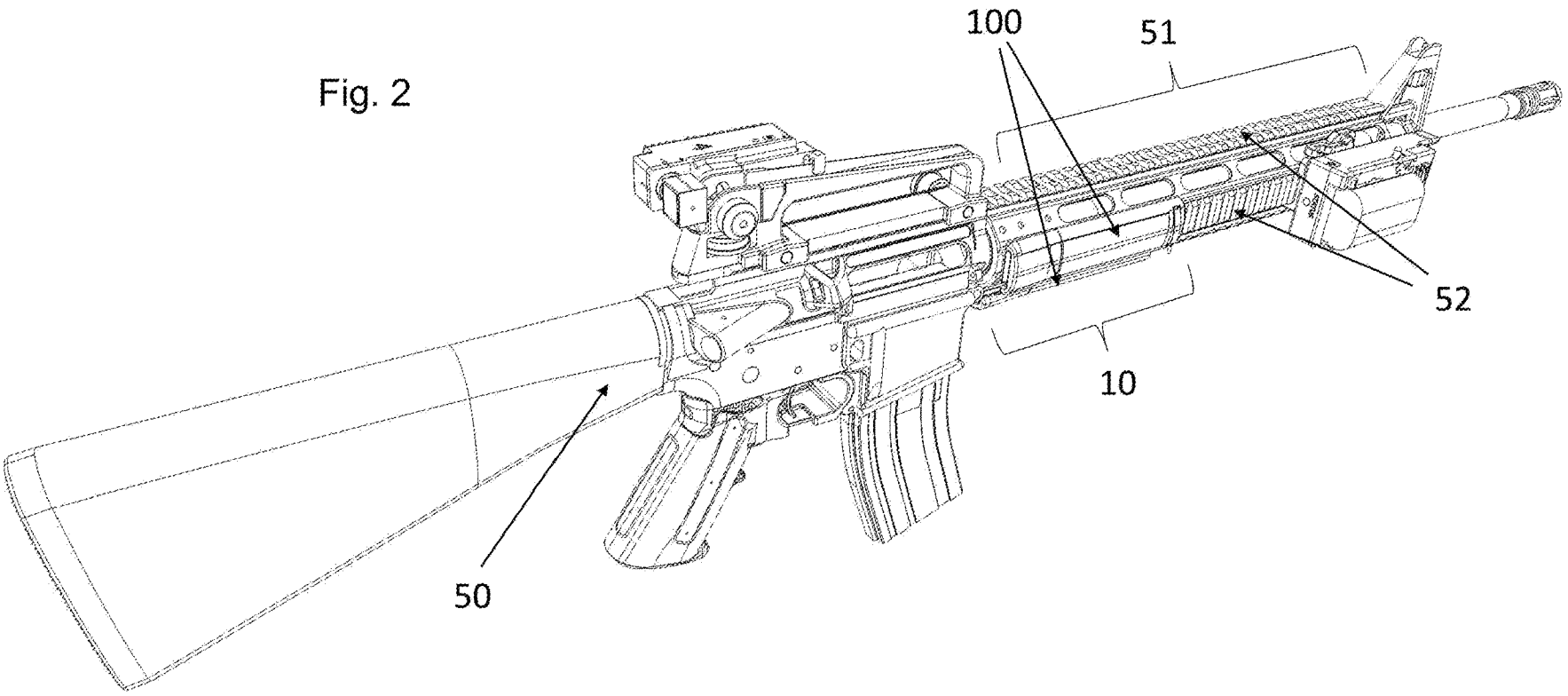
FIG. 2 is a perspective view of the device mounted on a weapon.

FIG. 2 shows the device 10 mounted on a weapon 50 with a foregrip 51. The foregrip 51 includes a plurality of Picatinny accessory rails 52. The plurality of sensor bodies 100 are mountable to the Picatinny accessory rails 52, particularly on the bottom, left and right surfaces of the rear-most portion of the foregrip 51.

Figure 3:
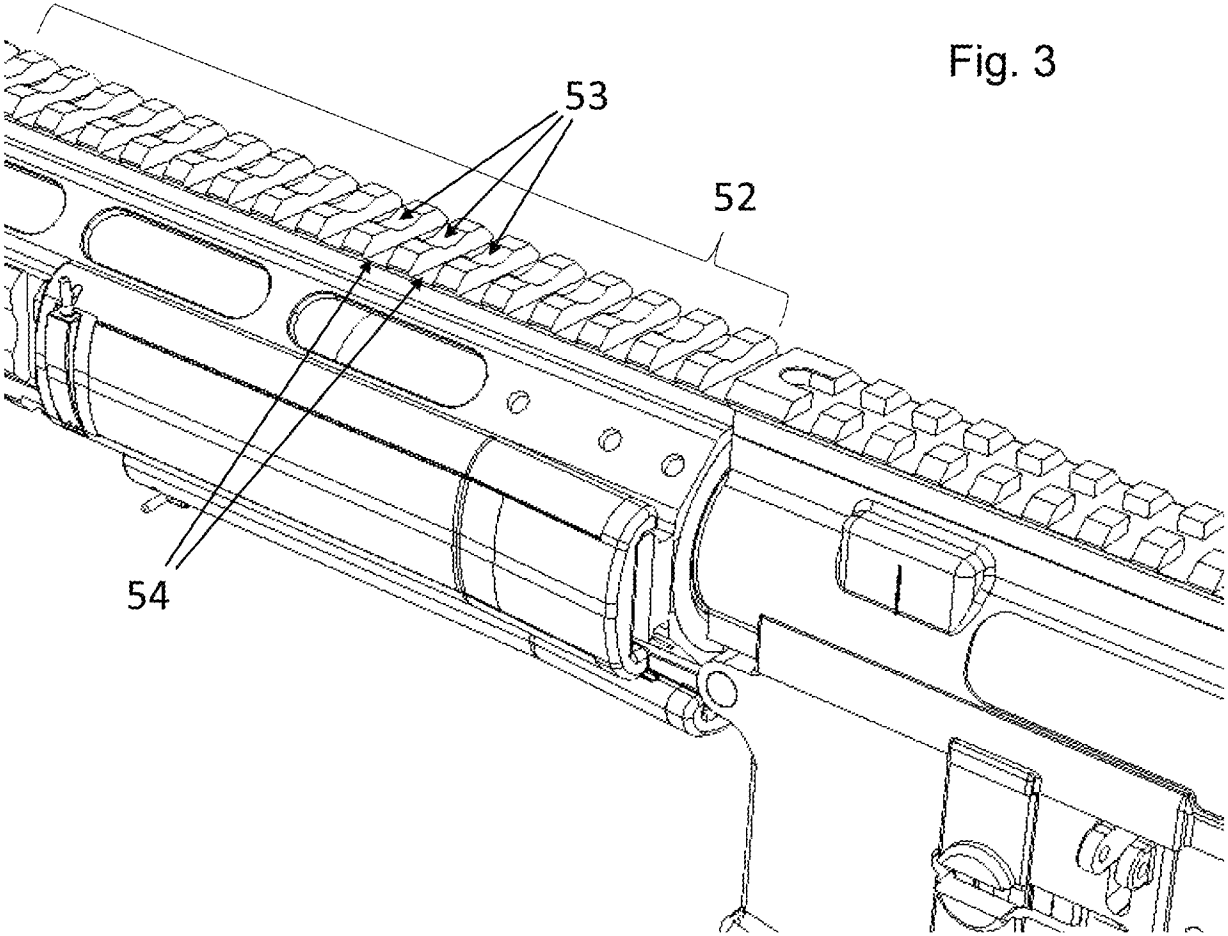
FIG. 3 is a perspective view of a Picatinny accessory rail system.

Shown in FIG. 3, a Picatinny accessory rail 52 can be described, but without limitation, as a military standard rail interface system disposed on a weapon 50. The Picatinny accessory rail 52 provides a mounting platform for firearm accessories and can be used to attach accessories, such as, but without limitation, iron sights, tactical lights, laser aiming modules, night vision devices, reflex sights, bipods, and slings. The Picatinny accessory rail 52 includes a plurality of Picatinny rail lands 53, which can be defined, but without limitation, as protrusions disposed on the outside of the Picatinny accessory rail 52. Additionally, there may be Picatinny rail channels 54 disposed between the Picatinny rail lands 53.

Figure 4:
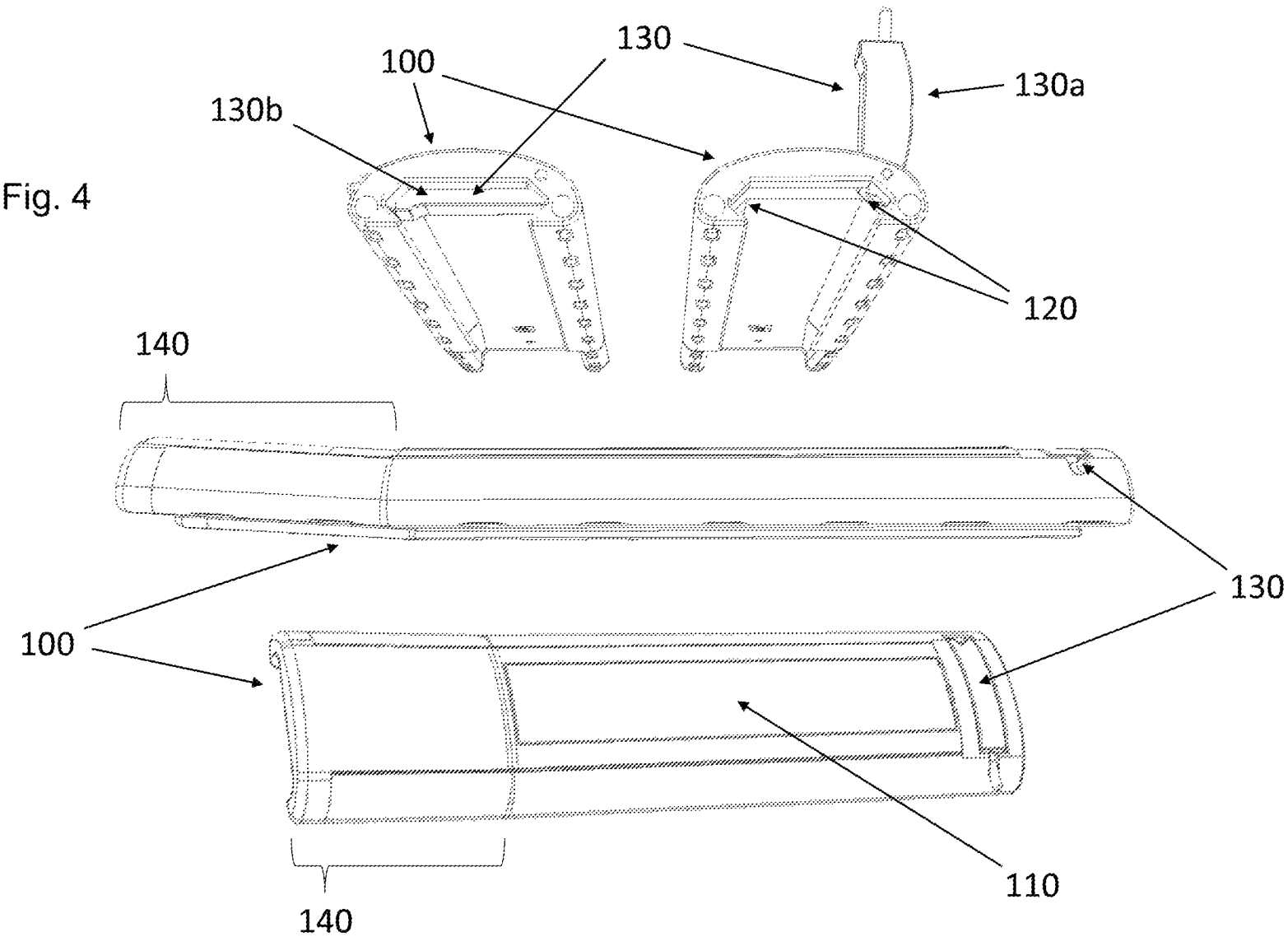
FIG. 4 is multiple perspective views of a foregrip pressure sensor body.

FIG. 4 shows the features of the sensor bodies 100. Each sensor body 100 has a pressure sensitive region 110 that can detect and transmit data on the pressure placed against the pressure sensitive region 110. Each sensor body 100 also has channels 120 that correspond to the shape of a Picatinny accessory rail 52, particularly the Picatinny rail lands 53, and a retention latch assembly 130, shown in both open **130*a* and closed 130*b* positions. The retention latch assembly 130 is such that, when in the closed 130*b* position, the retention latch assembly 130 secures the sensor body 100 by filling a Picatinny rail channel 54 and preventing the sensor body 100 movement on the rail. The sensor body 100 may also include a flared section 140 on its rear-most portion to allow that portion of the sensor body 100 to pass over the weapon barrel nut, allowing the sensor body 100 to be mounted as far rearward as possible on the Picatinny accessory rail 52. The flared section 140 allows the widest range of sensor body 100 mounting positions on the Picatinny accessory rail 52** in order to accommodate the widest variety of shooter hand positions.

Figure 5:
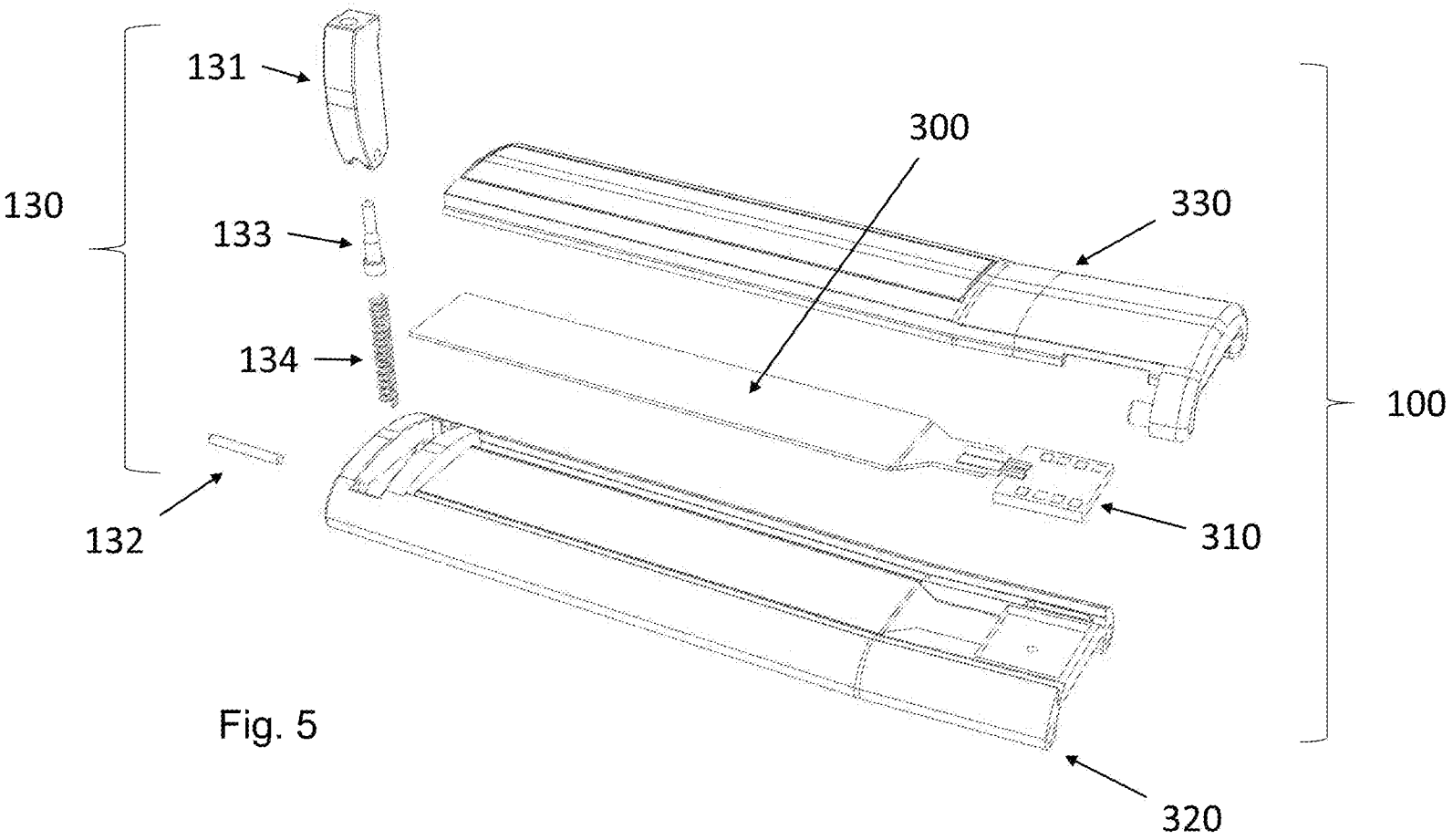
FIG. 5 is a perspective exploded diagram of the components of the foregrip pressure sensor body.

Referring to FIG. 5, in another embodiment of the invention, each sensor body 100 includes a force sensitive resistor 300 and an interconnected circuit board 310. The resistance of the force sensitive resistor 300 is inversely proportional to the pressure applied to its surface. The resistor 300 has a high impedance, 100 M ohms or more, when no pressure is applied. Pressure reduces the resistance seen across the resistor 300 to as low as a few hundred ohms when its surface is pressed hard. The resistor 300 and circuit board 310 are contained in a sensor body frame 320 and covered by a flexible rubber sensor cover 330, or any type of cover practicable. The flexible rubber sensor cover 330 allows the pressure applied by the shooter's hand on the surface of the cover 330 to be transmitted to the surface of the force sensitive resistor 300 beneath.

Still referring to FIG. 5, the retention latch assembly 130 may include a retention latch body 131, a dowel pin 132, a shoulder pin 133 and spring 134. In yet another embodiment of the invention, the retention latch body 131 is held in place by a dowel pin 132, allowing the retention latch assembly 130 to pivot about the dowel pin 132. When the retention latch assembly 130 is in the down and closed **130*b* position, the shoulder pin 133 is held by pressure from the spring 134 in a matching cavity in the sensor body 100, locking the retention latch assembly 130 in place. When in the closed 130*b* position, pressing on shoulder pin 133 where it protrudes from retention latch body 131 will cause the shoulder pin 133 to disengage from the matching cavity in the sensor body 100 and allow the retention latch assembly 130 to be moved to the open 130*a*** position.

Figure 6:
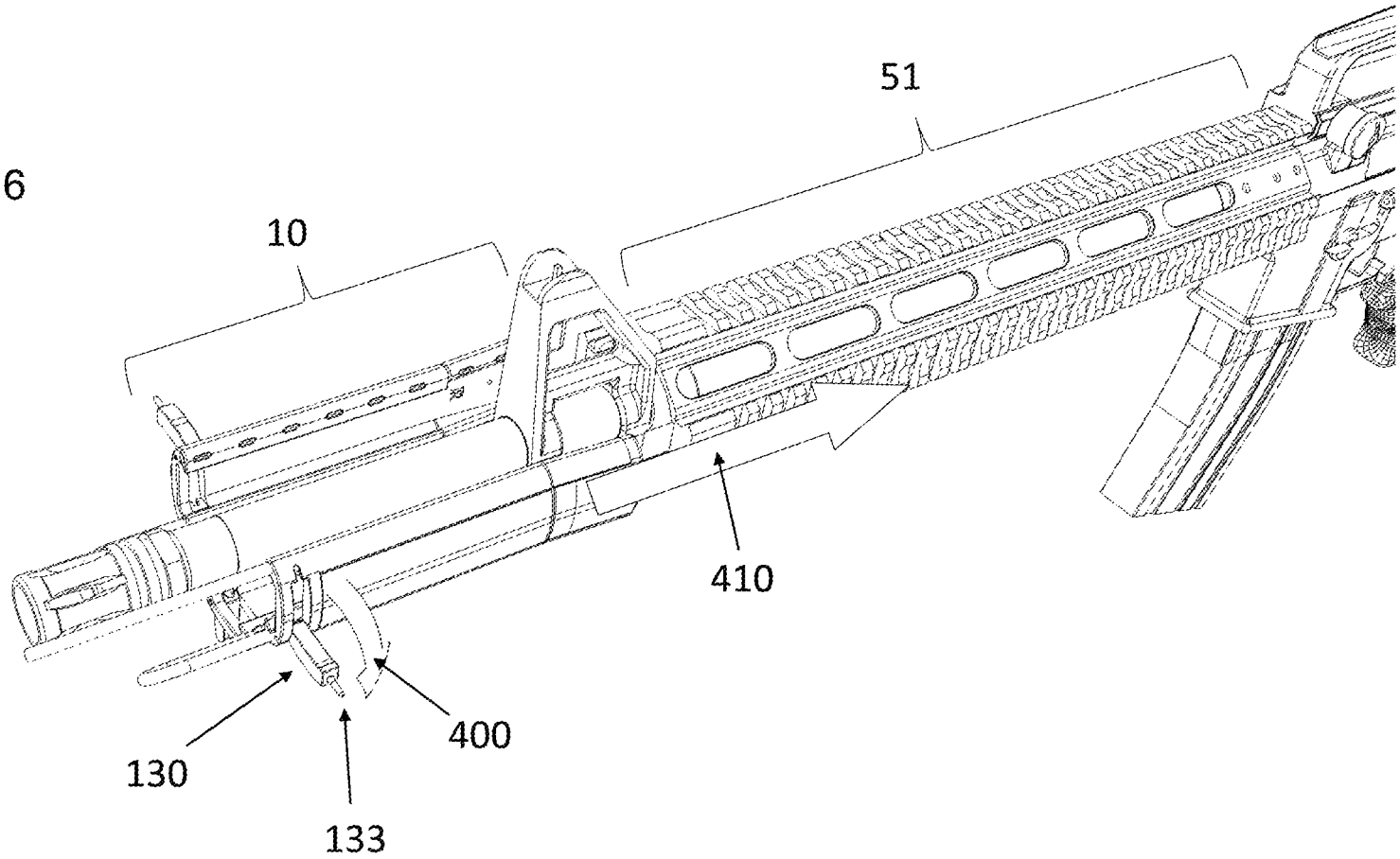
FIG. 6 is a perspective view of the start of the process of installing the foregrip pressure sensor device on a weapon.
Figure 7:
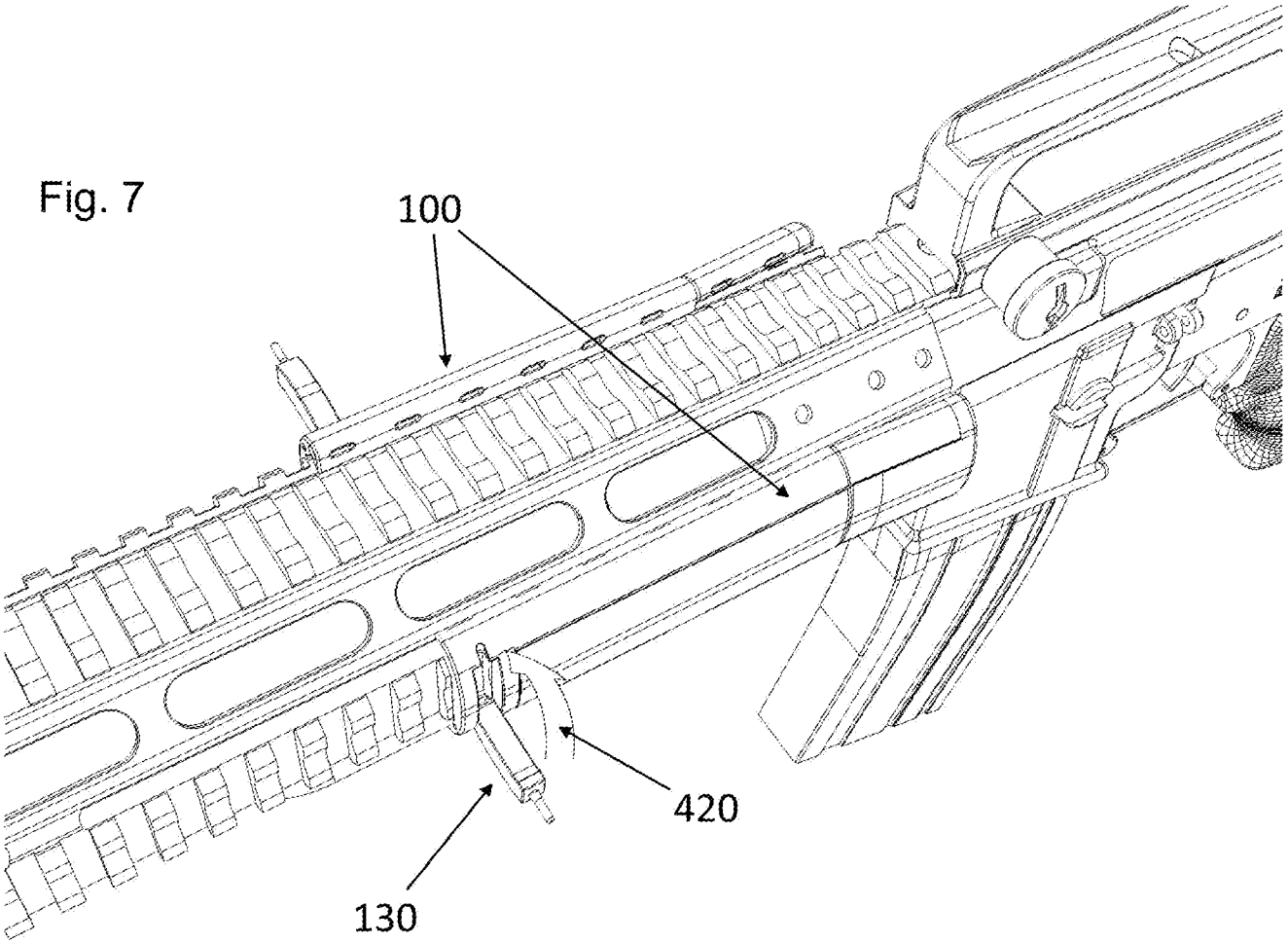
FIG. 7 is a perspective view of the foregrip pressure sensor device moved to its desired location on the weapon foregrip; and, FIG. 8 is a perspective view of the foregrip pressure sensor device successfully installed.
Figure 8:
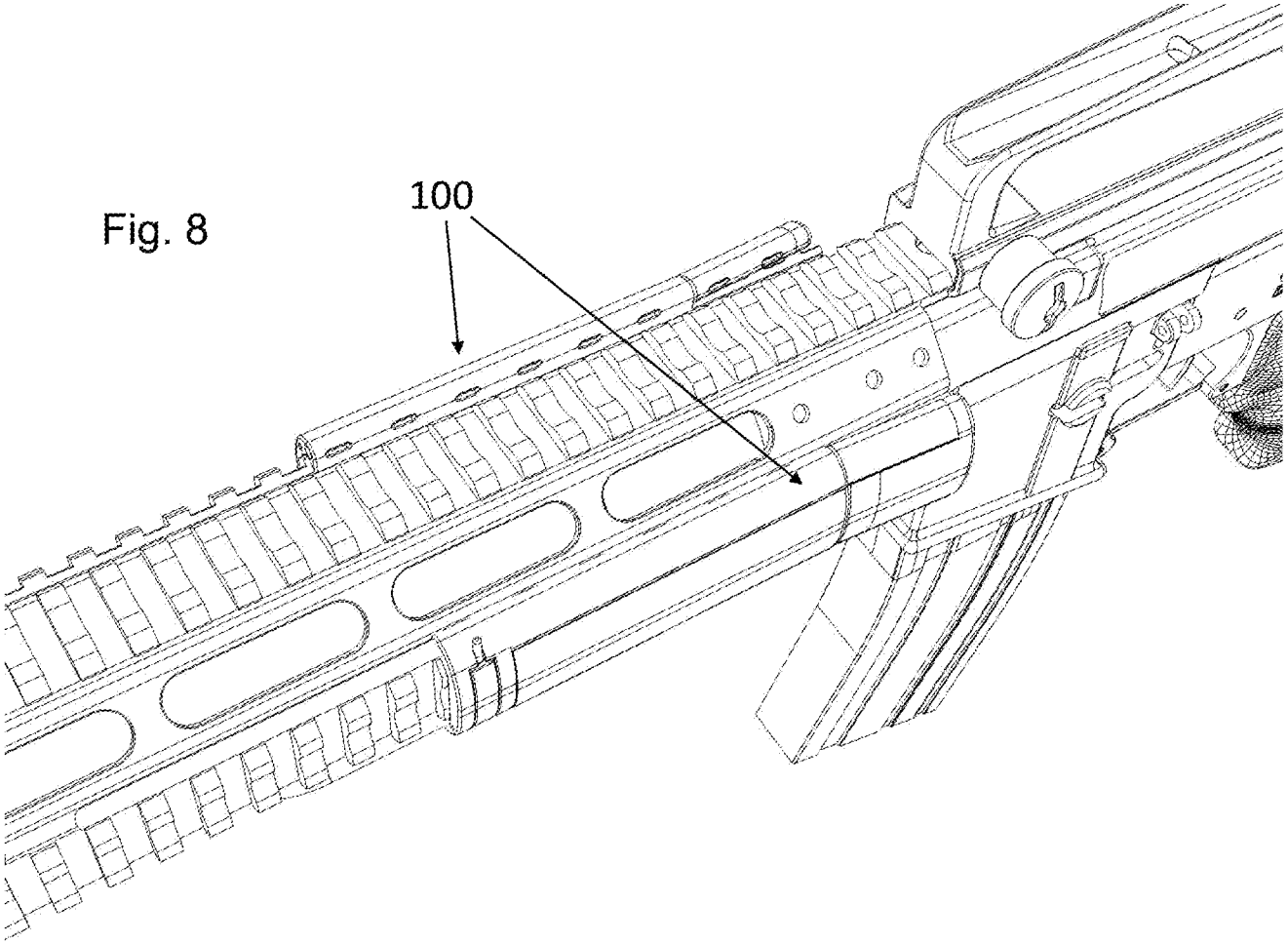

As shown in FIG. 6, in operation, the sensor device 10 may be installed on the weapon foregrip 51 under the shooter's support hand. This is typically the rear-most portion of the left, bottom, and right faces of the foregrip 51, but may be varied to accommodate the shooter's position and style of hold. The sensor body 100 retention latch assemblies 130 are opened by pressing on the shoulder pins 133, allowing the retention latch assemblies 130 to be moved (shown by arrow 400) to the open position. The sensor bodies 100 are then moved (shown by arrow 410) over the Picatinny accessory rails 52 from the front of the weapon so the Picatinny accessory rails 52, particularly the Picatinny rails lands 53, engage the channels 120 on the bottom of the sensor bodies 100. The sensor bodies 100 may be moved into the desired position and, as shown in FIG. 7, locked in place on the Picatinny accessory rail 52 by moving the retention latches assemblies 130 to their closed positions (shown by arrow 420). FIG. 8 shows the sensor bodies locked in position. Installation is completed by connecting the electrical connector 210 to the desired data collection device. The installation process is performed in reverse to remove the device from the weapon.

When introducing elements of the present invention or the preferred embodiment(s) thereof, the articles "a," "an," "the," and "said" are intended to mean there are one or more of the elements. The terms "comprising," "including," and "having" are intended to be inclusive and mean that there may be additional elements other than the listed elements.

Although the present invention has been described in considerable detail with reference to certain preferred embodiments thereof, other embodiments are possible. Therefore, the spirit and scope of the appended claims should not be limited to the description of the preferred embodiment(s) contained herein.

What is claimed is:

1. A device to capture pressure data from a weapon's foregrip during live fire, the weapon having a Picatinny accessory rail, the device comprising:

a plurality of sensor bodies that are mountable to the Picatinny accessory rail, each sensor body having a pressure sensitive region that can capture pressure data placed on the pressure sensitive region, each sensor body having channels that correspond to the Picatinny accessory rail, a retention latch system that attaches the sensor body to the weapon; and, a communication assembly that allows data communication between the plurality of sensor bodies and a computer.

* * * * *